US007715766B2

(12) United States Patent
Hayashi

(10) Patent No.: US 7,715,766 B2
(45) Date of Patent: May 11, 2010

(54) DEVELOPING UNIT AND IMAGE FORMING APPARATUS USING THE SAME

(75) Inventor: Shigeki Hayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 239 days.

(21) Appl. No.: 11/949,101

(22) Filed: Dec. 3, 2007

(65) Prior Publication Data

US 2008/0131171 A1 Jun. 5, 2008

(30) Foreign Application Priority Data

Dec. 5, 2006 (JP) ..... 2006-328474

(51) Int. Cl.
*G03G 15/09* (2006.01)

(52) U.S. Cl. ..... 399/273; 399/283

(58) Field of Classification Search ..... 399/98, 399/273, 274, 283

See application file for complete search history.

(56) References Cited

U.S. PATENT DOCUMENTS 5,387,963 A * 2/1995 Kajimoto et al. ..... 399/273 X
5,570,164 A * 10/1996 Yamamoto et al. ..... 399/283
6,026,265 A 2/2000 Kinoshita et al.
6,229,980 B1 * 5/2001 Ogawa et al. ..... 399/283
6,337,956 B1 1/2002 Sato et al.
6,347,208 B1 * 2/2002 Yamamoto ..... 399/283 X
7,315,717 B2 * 1/2008 Mizuta ..... 399/283

FOREIGN PATENT DOCUMENTS

| | | |
|---|---|---|
| CN | 1135443 C | 1/2004 |
| CN | 1135444 C | 1/2004 |
| JP | 07-177328 | 7/1995 |
| JP | 07-319279 | 12/1995 |
| JP | 2005-070400 | 3/2005 |

* cited by examiner

*Primary Examiner*—Sandra L Brase
(74) *Attorney, Agent, or Firm*—Renner, Otto, Boisselle & Sklar, LLP

(57) ABSTRACT

In a developing unit including a collecting roller for collecting the developer falling from a developing roller and a developer removing device for removing the developer collected by the collecting roller from the collecting roller, the developer removing device includes a casing for supporting the collecting roller, a scraper for removing the developer adhering to the collecting roller and a scraper supporter for supporting the scraper, and the scraper is supported by pressing it against the casing by the scraper supporter.

24 Claims, 10 Drawing Sheets

DEVELOPING UNIT AND IMAGE FORMING APPARATUS USING THE SAME

This Nonprovisional application claims priority under 35 U.S.C. §119(a) on Patent Application No. 2006-328474 filed in Japan on 5 Dec. 2006, the entire contents of which are hereby incorporated by reference.

BACKGROUND OF THE INVENTION (1) Field of the Invention

The present invention relates to a developing unit and an image forming apparatus using this. The present invention is, in particular, directed to a developing unit for visualizing an electrostatic latent image formed on a photoreceptor drum with a developer that has been electrified by blending two components, i.e., an electrostatically chargeable toner and a magnetic carrier, wherein toner which falls from the developing roller's developing area for supplying toner to the photoreceptor drum is collected, as well as to an image forming apparatus using this.

(2) Description of the Prior Art

In a conventional image forming apparatus such as a printer etc. using the electrophotography, a printout of an image is formed by electrifying a photoreceptor drum that is driven rotationally by a charger, forming an electrostatic latent image by illuminating the photoreceptor drum with light in accordance with image information, forming a toner image by applying toner to the electrostatic latent image by a developing unit and transferring the toner image to a sheet material or other recording media.

As a developer used for the developing unit of the image forming apparatus, use has been made of, for example a dual-component developer which is prepared by mixing two components, or an electrostatically chargeable toner and a magnetic carrier.

The thus constructed image forming apparatus entails the problem that the toner scattering from the developing roller of the developing unit adheres onto the photoreceptor drum surface and the thus adhering toner transfers to the recording medium, the transfer belt or the like, degrading image quality.

Further, with increase in the processing speed and with downsizing of the carrier particles (e.g., the carrier's particle size has reduced from 80 μm to 50 μm in diameter) to support high-speed configurations of recent image forming apparatus, another problem has emerged that the carrier drops from the developing roller surface, dirtying the apparatus interior and also producing scratches on the photoreceptor drum with the dropping carrier.

To deal with these conventional problems, there has been a proposal in that a toner collecting roller with a scraper is provided for the developing unit so as to collect scattered toner and the collected developer having adhered on the toner collecting roller is removed by the scraper (see patent document 1: Japanese Patent Application Laid-open Hei 7-319279).

When in the above-described prior art the scraper is mounted to the developing unit, it is a common practice that in order to make the scraper uniformly abut the toner collecting roller, the scraper is backed with a reinforcement arranged on the scraper supporting side and fixed to the scraper fixture etc., using screws at plural places (some or several places).

However, since the scraper becomes worn out at its front contact part which is put in sliding contact with the toner collecting roller, the scraper needs to be replaced periodically upon maintenance. For this reason, the scraper attachment structure with screw fastening as stated above entails the problem that the work in assembling the scraper and its replacement for maintenance are complicated.

Further, the attachment structure of the scraper with screw fastening gives rise to a fear that the scraper might be deformed by stress concentration at the screw-fastened positions and also makes the developing unit bulky.

SUMMARY OF THE INVENTION

The present invention has been devised in view of the above problems, it is therefore an object of the present invention to provide a developing unit which permits its scraper to be assembled and disassembled with one-touch handling and can realize uniform abutment of the scraper against its toner collecting roller without deforming the scraper, hence can prevent the photoreceptor drum from being damaged with the falling developer and can prevent degradation of image quality, as well as providing an image forming apparatus using the developing unit.

In order to solve the above problem, the developing unit and image forming apparatus using the developing unit according to the present invention are configured as follows.

A developing unit according to the first aspect of the present invention is one that visualizes an electrostatic latent image formed on, for example a photoreceptor drum as an electrostatic latent image bearer with a developer that is prepared and electrified by mixing two components, an electrostatically chargeable toner and magnetic carrier, comprising: a collecting roller for collecting the developer falling from the developing area of a developing roller that supplies the toner to the photoreceptor drum; and a developer remover for removing the developer collected by the collecting roller from the collecting roller, and is characterized in that the developer remover comprises: a casing for supporting the collecting roller; a scraper disposed elongated along the axial direction of the collecting roller and abutted against the outer periphery of the collecting roller so as to scrape off the developer adhering to the outer periphery of the collecting roller; and, a supporter for supporting the scraper, and the supporter presses the scraper against the casing to hold the scraper.

A developing unit according to the second aspect of the present invention is characterized in that, in addition to the above first configuration, the casing comprises: a collecting roller supporter for rotatably supporting the collecting roller; a first scraper supporting part for supporting the scraper; and, a first attachment part to which the supporter is attached, the casing is mounted to the developing unit body which has the developing roller disposed therein and stores the developer, and the supporter comprises: a second attachment part attached to the first attachment part; and a second scraper supporting part for supporting the scraper against the first scraper supporting part along the axial direction of the collecting roller.

A developing unit according to the third aspect of the present invention is characterized in that, in addition to the above second configuration, the first scraper supporting part or the second scraper supporting part includes a scraper positioning portion for positioning the scraper, and the scraper has a scraper-side engaging portion corresponding to the scraper positioning portion.

It is preferable in the present invention to provide projections as the scraper positioning portion in the casing by so-called half-punching while forming fitting holes as the scraper-side engaging portions that correspond to the scraper positioning portion.

A developing unit according to the fourth aspect of the present invention is characterized in that, in addition to the above third configuration, the scraper positioning portion has first and second scraper positioning projections that are formed at both longitudinal ends of the first scraper supporting part or the second scraper supporting part and are projected towards the side to which the scraper is attached, and the scraper-side engaging portion has first and second scraper-side engaging portions, the first scraper-side engaging portion having a configuration for fitting the first scraper positioning projection therein, and the second scraper-side engaging portion having a configuration that allows for movable engagement of the second scraper positioning projection with respect to the longitudinal direction of the first scraper supporting part or the second scraper supporting part.

It is preferable in the present invention to provide a pair of circular projections as the scraper positioning portion in the casing by so-called half-punching while forming a circular fitting hole (first scraper-side engaging portion) and an elongated (elliptic) fitting hole (second scraper-side engaging portion) as the scraper-side engaging portions that correspond to the scraper positioning portion.

A developing unit according to the fifth aspect of the present invention is characterized in that, in addition to any one of the above second to fourth configurations, the first attachment part has a supporter positioning portion for positioning the supporter, and the second attachment part has a supporter-side engaging portion corresponding to the supporter positioning portion.

It is preferable in the present invention to provide projections as the supporter-positioning portion in the casing by so-called half-punching while forming fitting holes as the supporter-side engaging portions that correspond to the supporter positioning portion.

A developing unit according to the sixth aspect of the present invention is characterized in that, in addition to the above fifth configuration, the supporter positioning portion has first and second supporter positioning projections that are formed at both longitudinal ends of the first attachment part and are projected towards the side to which the supporter is attached, and the supporter-side engaging portion has first and second supporter-side engaging portions, the first supporter-side engaging portion having a configuration for fitting the first supporter positioning projection therein, and the second supporter-side engaging portion having a configuration that allows for movable engagement of the second supporter positioning projection with respect to the longitudinal direction of the first attachment part.

It is preferable in the present invention to provide a pair of circular projections as the supporter positioning portion in the casing by so-called half-punching while forming a circular fitting hole (first supporter-side engaging portion) and an elongated (elliptic) fitting hole (second supporter-side engaging portion) as the supporter-side engaging portions that correspond to the supporter positioning portion.

A developing unit according to the seventh aspect of the present invention is characterized in that, in addition to any one of the above first to sixth configurations, the scraper includes a plate-like blade and a holder for holding the blade, and the holder is laid over the blade along the longitudinal direction of the blade.

A developing unit according to the eighth aspect of the present invention is characterized in that, in addition to any one of the above first to seventh configurations, the supporter is formed of a leaf-spring material, abuts the scraper uniformly with respect to the axial direction of the collecting roller and presses the scraper toward the casing.

A developing unit according to the ninth aspect of the present invention is characterized in that, in addition to any one of the above first to eighth configurations, the supporter is formed so that the distal end of the abutment portion that abuts the scraper against the casing is bent or curved in a direction opposite to the scraper.

A developing unit according to the tenth aspect of the present invention is characterized in that, in addition to any one of the above second to ninth configurations, the collecting roller supporter axially and rotatably supports the collecting roller at both ends thereof by means of resinous bearings.

An image forming apparatus according to the eleventh aspect of the present invention is one which includes a developing unit for visualizing an electrostatic latent image formed on, for example, a photoreceptor drum as an electrostatic latent image bearer with a developer that is prepared and electrified by mixing two components, an electrostatically chargeable toner and magnetic carrier, comprising: a collecting roller for collecting the developer falling from the developing area of a developing roller that supplies the toner to the photoreceptor drum; and a developer remover for removing the developer collected by the collecting roller from the collecting roller, and which produces a printed output of an image by transferring a developer image formed on the surface of the photoreceptor drum to a transfer medium, by an electrophotographic process, and is characterized in that a developing unit defined in any one of the above first to tenth aspects is used as the developing unit.

According to the first aspect of the invention, since the scraper can be mounted to the casing easily without the need of fastening the scraper with screws, it is possible to replace the scraper with one-touch handling and it is also possible to realize uniform abutment of the scraper against the collecting roller without causing any scraper deformation. As a result, it is possible to remove the developer from the collecting roller in a reliable manner, hence realize a developing unit that can prevent the photoreceptor drum from being damaged with falling developer and can inhibit degradation of image quality.

Further, since the collecting roller and scraper are assembled to the casing that is prepared separately from the developing unit, it is possible to position and fix the scraper with high precision based on the collecting roller by use of the casing in a simple manner, compared to the conventional practice in which the scraper has to be positioned with precision relative to the collecting roller that is positioned and held on the developing unit side.

According to the second aspect of the invention, in addition to the effect obtained from the first aspect, it is possible to insert and mount the scraper easily by virtue of the second scraper supporting part without the need to assemble or disassemble the supporter and/or the scraper with screw-fastening or the like.

According to the third aspect of the invention, in addition to the effect obtained from the second aspect, the scraper can be easily positioned relative to the casing with improved positioning accuracy.

According to the fourth aspect of the invention, in addition to the effect obtained from the third aspect, the scraper can be easily positioned relative to the casing with precision along its longitudinal direction or the axial direction of the collecting roller.

According to the fifth aspect of the invention, in addition to the effects obtained from the second to fourth aspects, the scraper supporter can be easily positioned relative to the casing with improved positioning accuracy.

According to the sixth aspect of the invention, in addition to the effect obtained from the fifth aspect, the supporter can be easily positioned with precision relative to the casing along its longitudinal direction or the axial direction of the collecting roller.

According to the seventh aspect of the invention, in addition to the effects obtained from the first to sixth aspects, the rigidity of the blade can be uniformly enhanced.

According to the eighth aspect of the invention, in addition to the effects obtained from the first to seventh aspects, since the scraper can be pressed uniformly across its whole surface by the elastic force of the supporter, the scraper can be stably pressed against the casing.

According to the ninth aspect of the invention, in addition to the effects obtained from the first to eighth aspects, it is possible to enhance the strength of the second scraper supporting part, and also perform easy scraper insertion.

According to the tenth aspect of the invention, in addition to the effects obtained from the second to ninth aspects, it is possible to keep the relative position of the collecting roller and the scraper with precision.

According to the eleventh aspect of the invention, since the scraper can be replaced by one-touch handling without the need of fastening the scraper with screws, it is possible to improve the assembly and maintenance performance of the scraper. Further, since the scraper can be abutted uniformly against the toner collecting roller without causing any scraper deformation, it is possible to scrape the collected developer in a reliable manner. As a result, it is possible to collect the falling developer efficiently, hence it is possible to realize a developing unit which prevents the photoreceptor drum from being damaged by the developer and realizes prevention against degradation of image quality.

DESCRIPTION OF THE PREFERRED EMBODIMENTS

The best mode for carrying out the present invention will hereinafter be described with reference to the accompanying drawings.

Figure 1:
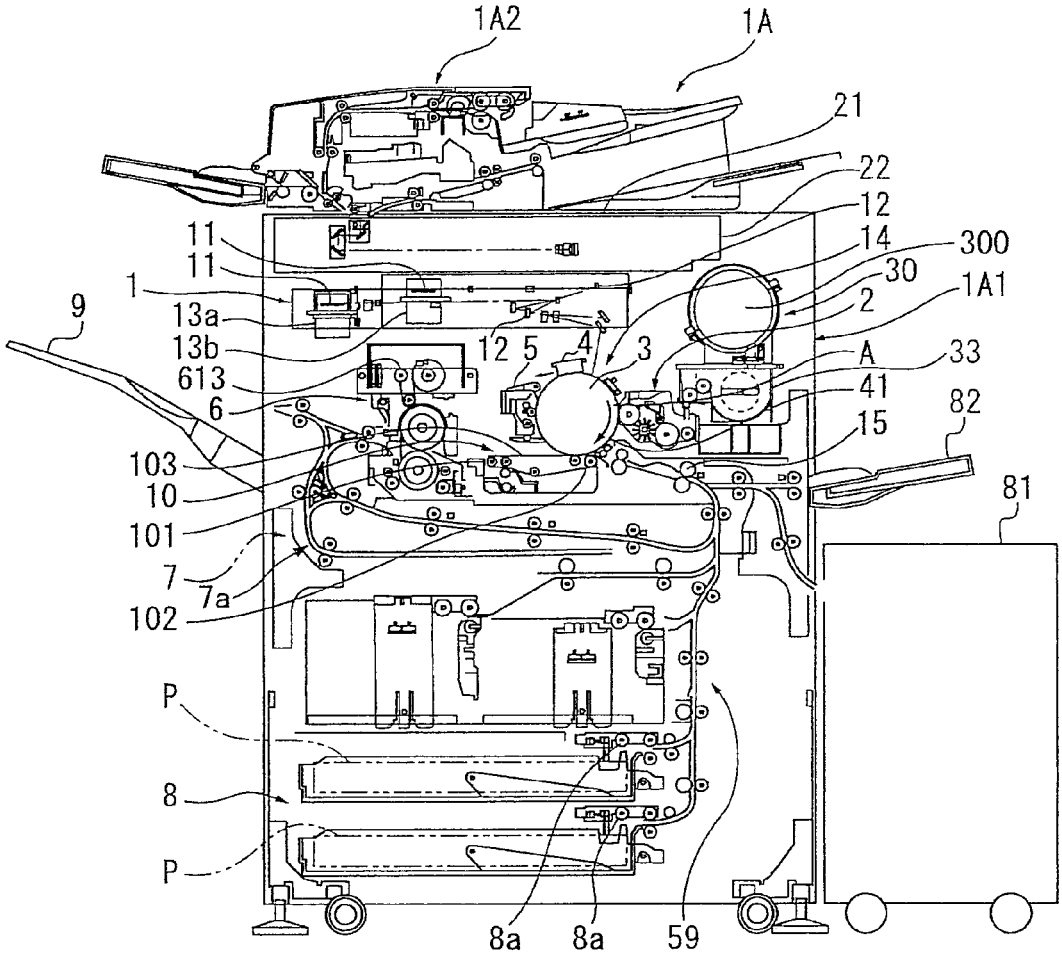
FIG. 1 is an illustrative view showing an overall configuration of an image forming apparatus according to the embodiment of the present invention.
Figure 2:
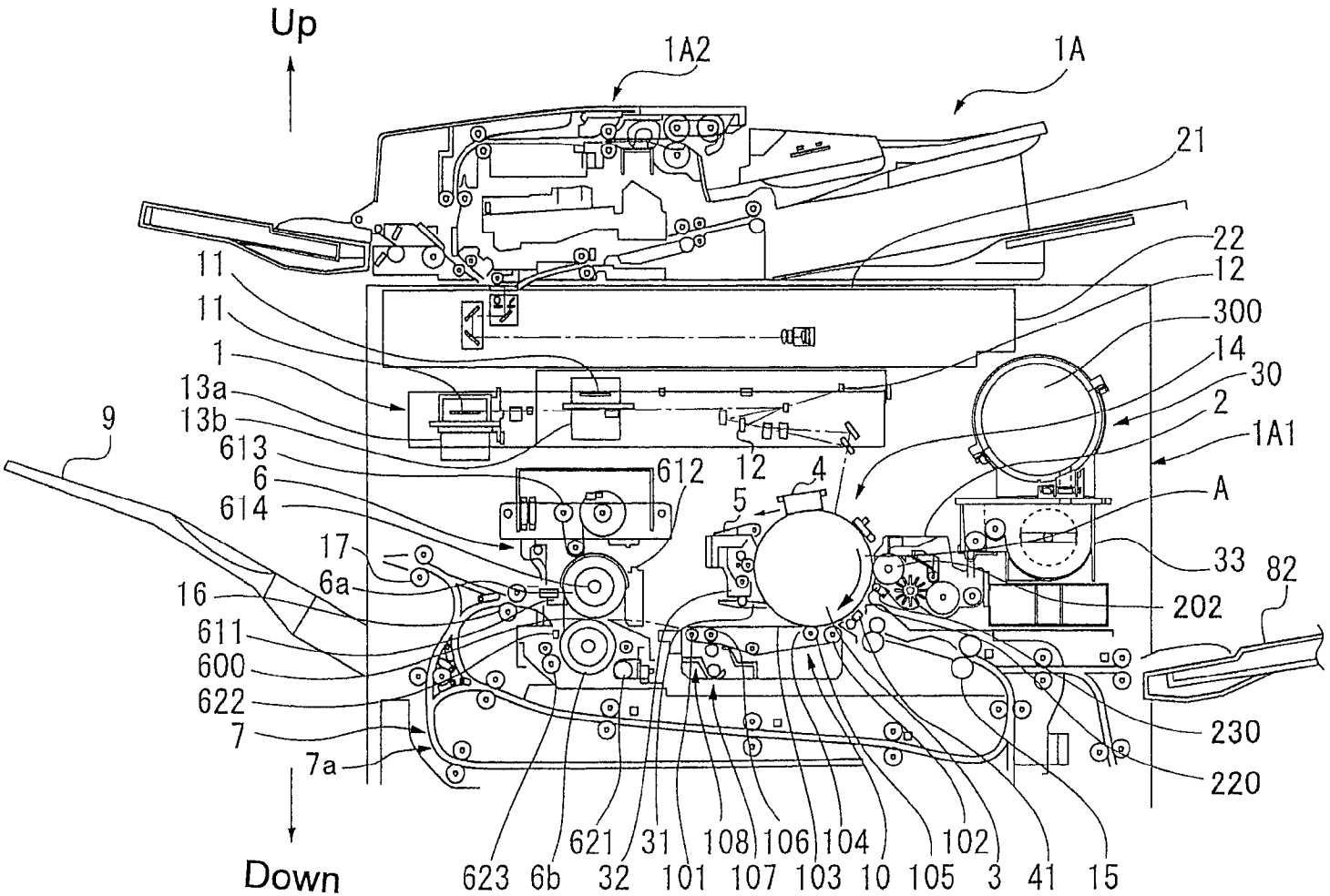
FIG. 2 is a partial detailed view showing the configuration of the apparatus body of the image forming apparatus.

FIG. 1 shows one embodiment of the present invention and is an illustrative view showing an overall configuration of an image forming apparatus according to the embodiment of the present invention. FIG. 2 is a partial detailed view showing the configuration of an apparatus body of the same image forming apparatus.

As shown in FIGS. 1 and 2 an image forming apparatus 1A according to the present embodiment processes image data captured by a scanner etc., or image data transmitted from without to output a monochrome (single color) image, based on the electrophotography, by forming an electrostatic latent image on a rotationally driven, cylindrical photoreceptor drum (electrostatic latent image bearer) 3, visualizing the electrostatic latent image with an electrified developer prepared by mixing two components, or an electrostatically chargeable toner and magnetic carrier, and transferring the developed image to a predetermined sheet of recording paper (to be referred to as paper hereinbelow) as a recording medium. A developing unit for visualizing the electrostatic latent image on photoreceptor drum 3 includes, as shown in FIG. 2, a collecting roller 220 for collecting the developer falling from the developing area of a developing roller 202 for supplying toner to photoreceptor drum 3 and a developer removing device (developer remover) 230 for removing the developer collected by collecting roller 220 therefrom.

As shown in FIG. 1, this image forming apparatus 1A includes a paper feed tray 8 which can stack multiple sheets of paper P thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed on to the paper. The image forming apparatus, based on the conveying speeds of paper P corresponding to a multiple number of preset printout processing modes, can select and control the conveying speed of paper P in accordance with a print request and automatically feed paper P from paper feed tray 8 to a paper output tray 9.

To begin with, the overall configuration of image forming apparatus 1A will be described.

Image forming apparatus 1A is essentially composed of, as shown in FIG. 1, an apparatus body 1A1 including a light exposure unit 1, a developing unit 2, a toner feed device 30, a photoreceptor drum 3, a charger 4, a charge erasing device 41, a cleaner unit 5, a fixing unit 6, paper conveyor system 7, a paper feed path 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on the top of this original placement table 21 so that it can pivotally open upwards, while a scanner portion 22 as a document reader for reading image information of originals is arranged under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed path 7*a*, paper output tray 9 and transfer device 10. Further, paper feed tray 8 that accommodates paper P therein is arranged under these.

Light exposure unit 1 provides a function of emitting laser beam in accordance with the image data output from an unillustrated image processor to irradiate the photoreceptor drum 3 surface that has been uniformly electrified by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* including laser emitters 11, 11 and a reflection mirror 12.

In the present embodiment, in order to achieve high-speed printing operation, multiple laser beams from multiple laser emitters 11 are used to reduce the irradiation frequency of each laser beam (the processing load of each laser beam per unit time is reduced). More specifically, a two-beam technique using a pair of laser emitters 11 to emit two laser beams is adopted.

Here, in the present embodiment laser scanning units (LSUs) 13*a* and 13*b* are used for light exposure unit 1, but an array of light emitting elements, e.g., an EL (electroluminescence) or LED (light-emitting diode) writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged along the peripheral surface of this photoreceptor drum 3, starting from the position at which image transfer ends downstream in the rotational direction of the photoreceptor drum are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper P.

Here, as a drive means for paper separation claw 31, a drive motor or the like may be used instead of solenoid 32, or any other drive means may also be selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium feed direction. This developing unit 2 will be detailed later.

Toner feed device 30 temporarily holds the toner discharged from a toner container 300 filled with toner, in an intermediate hopper 33 and then supplies it to developing unit 2. This toner feed device is arranged adjacent to developing unit 2.

Registration roller 15 is operated and controlled by an unillustrated drive means and control means so as to convey the paper P delivered from paper feed tray 8 into and between photoreceptor drum 3 and a transfer belt 103 whilst making the leading end of the paper P register with the toner image on the photoreceptor drum 3.

Charger 4 is a charging means for uniformly charging the photoreceptor drum 3 surface at a predetermined potential, and is arranged over photoreceptor drum 3 and close to the outer peripheral surface thereof.

Here, a discharge type charger 4 is used in the present embodiment, but a contact roller type or a brush type may be used instead.

Charge erasing device 41 is a pre-transfer erasing means for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same.

Though in the present embodiment, charge erasing device 41 is configured using a charge erasing electrode, a charge erasing lamp or any other method can be used instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed as transfer device 10 applies an electric field having an opposite polarity to that of the electric charge of the electrostatic image. For example, when the electrostatic image bears negative (−) charge, the applied polarity of transfer device 10 should be positive (+).

Transfer device 10 is provided as a transfer belt unit in which a transfer belt 103 having a predetermined resistivity (ranging from $1\times10^{9}$ to $1\times10^{13}\Omega\cdot$cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3.

An elastic conductive roller 105 (FIG. 2) having a conductivity different from that of drive roller 101 and driven roller 102 and capable of applying a transfer electric field is laid out at a contact point 104 (FIG. 2) where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 for erasing the electric field that has been applied to the paper P being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P.

Fixing unit 6 includes a heat roller 6*a* and a pressing roller 6*b* as shown in FIG. 2 and fuses and fixes the toner image transferred on paper P by rotating heat roller 6*a* so as to convey the paper P held between heat roller 6*a* and pressing roller 6*b* through the nip therebetween. Arranged on the downstream side of fixing unit 6 with respect to the direction of paper feed is a conveyance roller 16 for conveying paper P.

Arranged on the downstream side of this conveyance roller 16 with respect to the direction of paper feed is a paper discharge roller 17 for discharging paper P to paper output tray 9.

Heat roller 6*a* has a sheet separation claw 611, a thermistor 612 as a roller surface temperature detector and a roller surface cleaning member 613, all arranged on the outer periphery thereof and also includes a heat source 614 for heating the heat roller surface at a predetermined temperature (set fixing temperature: approximately 160 to 200 deg. C.) in the interior part thereof.

Pressing roller 6*b* is provided at its each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by the anchoring effect to the paper P by the pressing force from heat roller 6*a* and pressing roller 6*b*.

As shown in FIG. 1, paper feed tray 8 stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper part on the paper output side of this paper feed tray 8.

This paper pickup roller 8*a* picks up paper P, sheet by sheet, from the topmost of a stack of paper stored in paper feed tray 8, and conveys the paper downstream (for convenience' sake, the supply side of paper P (the cassette side) is referred to as upstream and the paper output side is referred to as downstream) to the registration roller (also called "idle roller") 15 side in paper feed path 7*a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged over the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and the like and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feed path 7*a* provided for paper conveyor system 7, to transfer device 10, where a toner image is transferred from photo receptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present embodiment, two predetermined output processing modes, namely, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Next, developing unit 2 and its peripheral components that constitute image forming apparatus 1A according to the present embodiment will be described with reference to the drawings.

Figure 3:
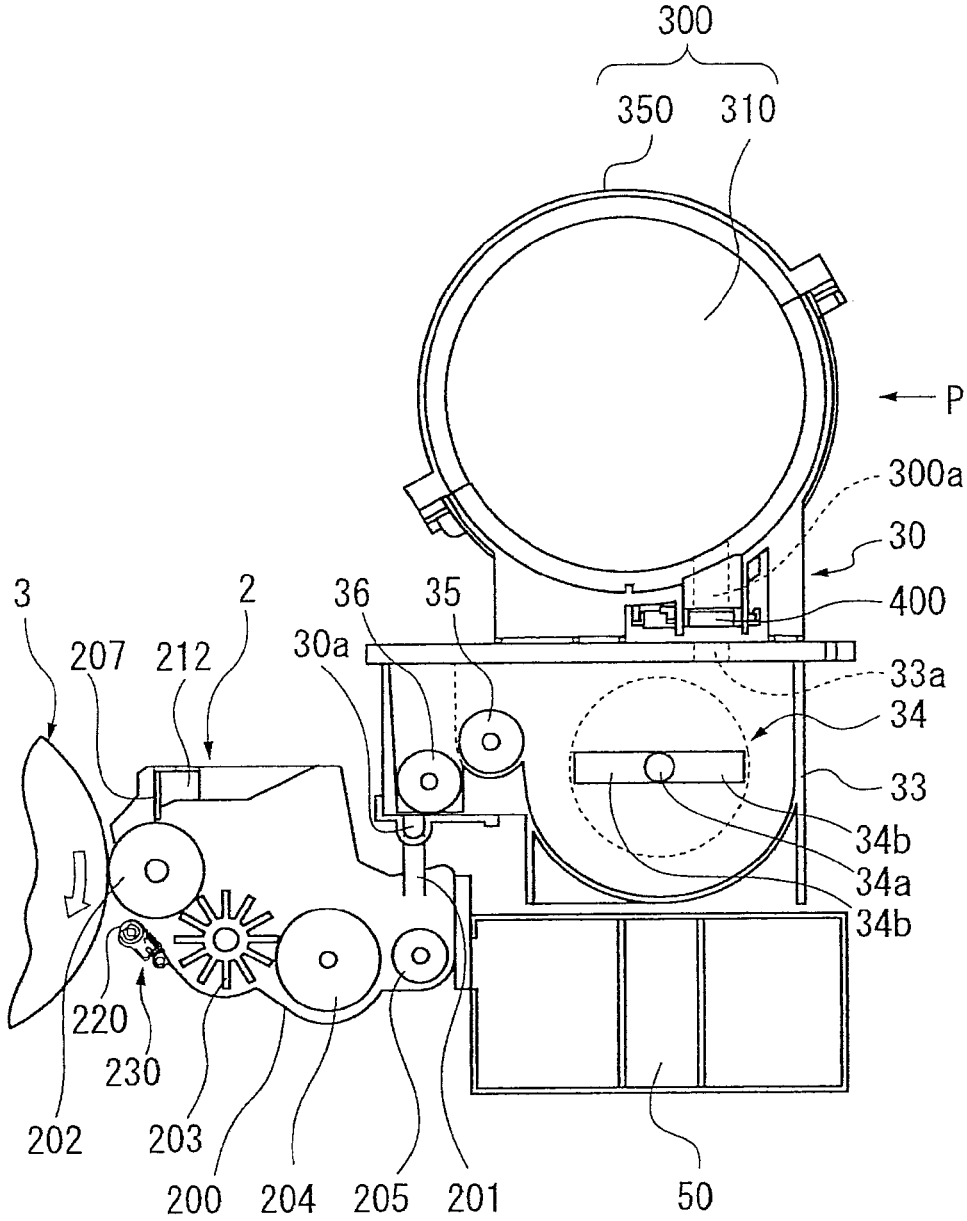
FIG. 3 is an overall side sectional view showing a developing unit and toner feed device that constitute the image forming apparatus.

FIG. 3 is an overall side sectional view showing a developing unit and toner feed device that constitute the image forming apparatus according to the present embodiment.

In this embodiment, as shown in FIG. 3, toner feed device 30 is arranged adjacent to developing unit 2. A duct 50 for sending air to a hopper 200 that forms the exterior of developing unit 2 is provided under this toner feed device 30 in order to forcibly remove heat arising during the operation of developing unit 2.

Toner feed device 30 is arranged adjacent to developing unit 2, and temporarily reserves the toner discharged from toner container 300 filled with toner, in intermediate hopper 33 and then feeds the toner to developing unit 2. In the present embodiment, toner container 300 is configured so that a container body 310 charged with toner is rotatably supported by a supporting structure 350.

The toner thus sent out to intermediate hopper 33 is agitated therein by an agitator 34 first. Agitator 34 is composed of an agitator shaft 34*a* and agitating vanes 34*b* attached thereto. As agitator shaft 34*a* turns, agitating vanes 34*b* rotate about agitator shaft 34*a* to thereby agitate the toner in intermediate hopper 33 that has been fed from toner container 300.

The toner thus agitated by agitator 34 is sent by the agitating action of agitator 34 and conveyed to the feed roller 36 side via a conveying roller 35. Feed roller 36 sends out the toner that has been conveyed from agitator 34 via conveying roller 35, to an opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing a toner feed aperture 300*a* through which toner supplied from toner container 300 is discharged out of supporting structure 350, as shown in FIG. 3. Specifically, as toner feed aperture 300*a* of supporting structure 350 is released by shutter opening and closing mechanism 400, communication between toner feed aperture 300*a* and opening 33*a* provided for intermediate hopper 33 is established, so that the toner discharged from toner container 300 is supplied to intermediate hopper 33.

Next, the characteristic configuration of developing unit 2 according to the present embodiment will be described in detail with reference to the drawings.

Figure 4:
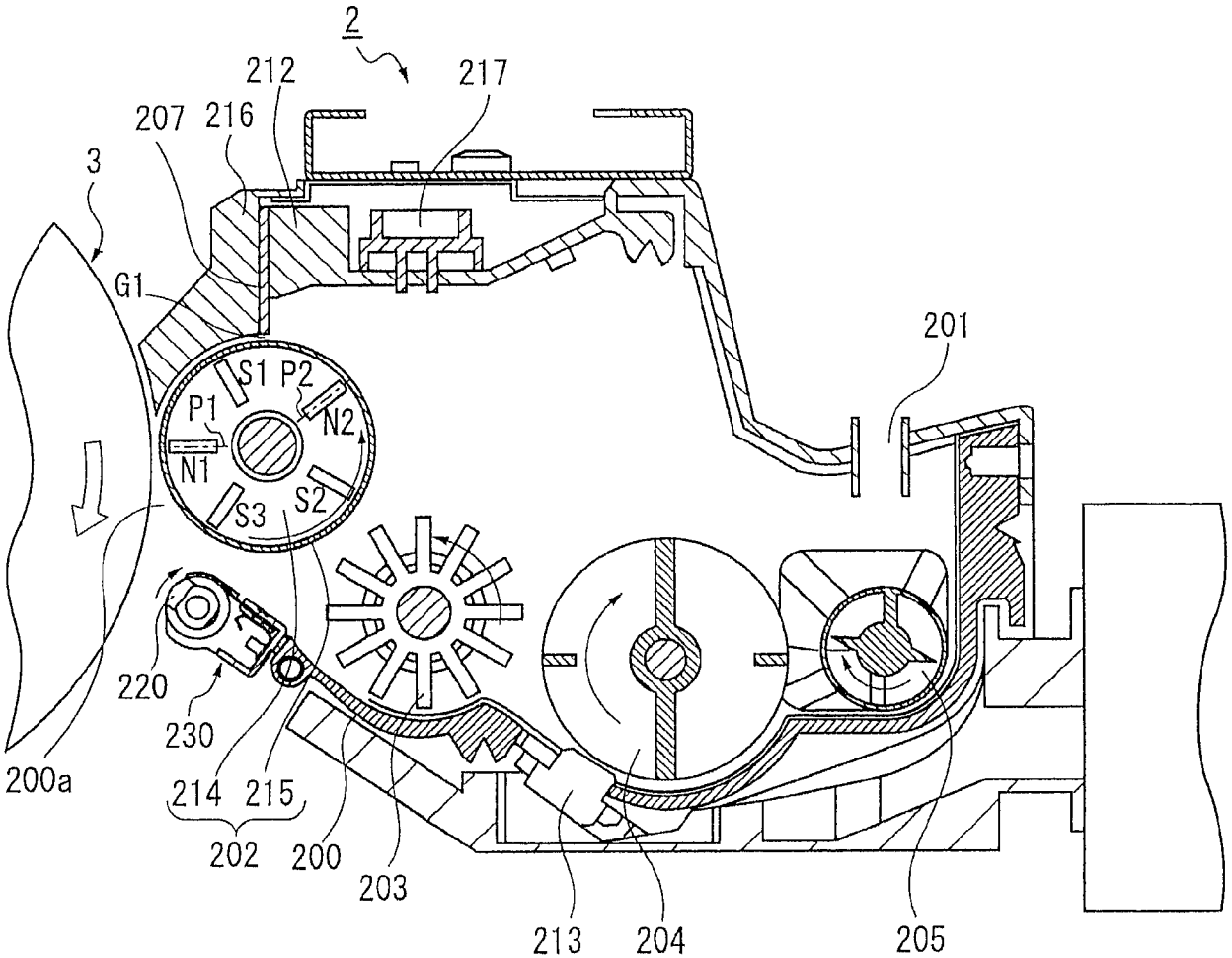
FIG. 4 is a sectional view showing the configuration of the developing unit.
Figure 5A:
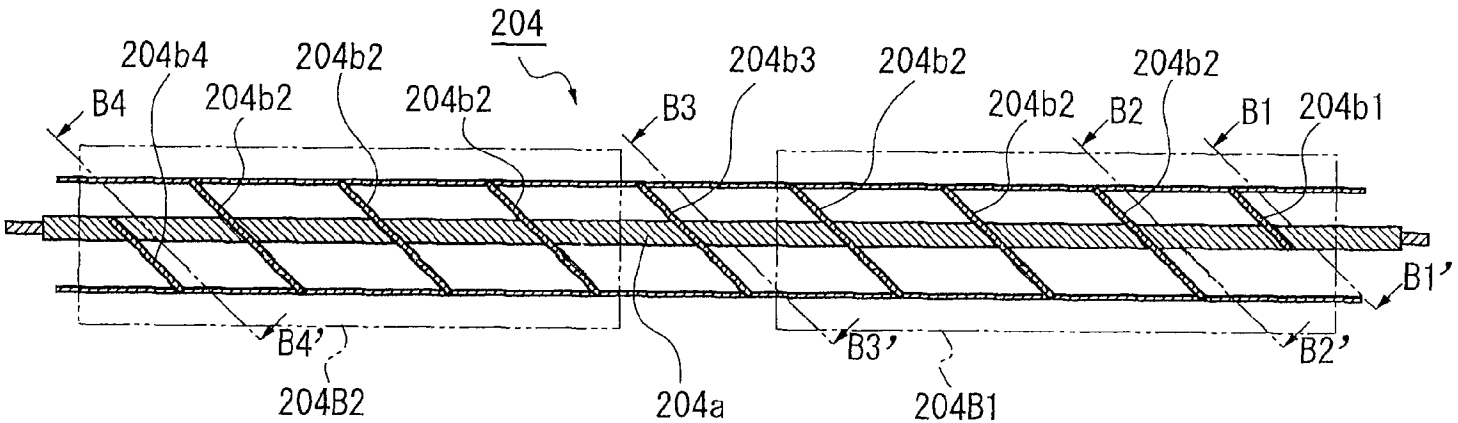
FIG. 5A is a side sectional view showing a configuration of a mixing roller that constitutes the developing unit of the same embodiment.
Figure 5B:
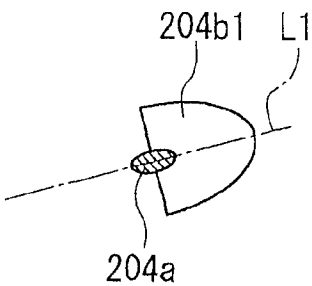
FIG. 5B is a sectional view cut along a plane B1-B1' in FIG. 5A.
Figure 5C:
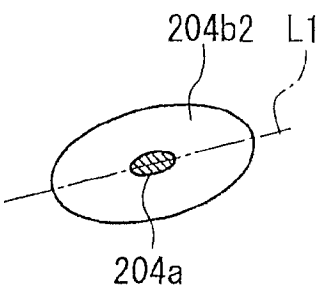
FIG. 5C is a sectional view cut along a plane B2-B2' in FIG. 5A.
Figure 5D:
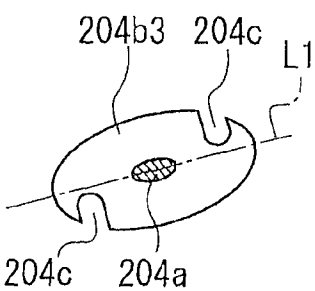
FIG. 5D is a sectional view cut along a plane B3-B3' in FIG. 5A.
Figure 5E:
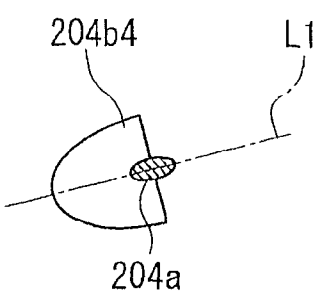
FIG. 5E is a sectional view cut along a plane B4-B4' in FIG. 5A.

FIG. 4 is a sectional view showing the configuration of the developing unit according to the present embodiment; FIG. 5A is a side sectional view showing a configuration of a mixing roller that constitutes the developing unit; FIG. 5B is a sectional view cut along a plane B1-B1' in FIG. 5A; FIG. 5C is a sectional view cut along a plane B2-B2' in FIG. 5A; FIG. 5D is a sectional view cut along a plane B3-B3' in FIG. 5A; and FIG. 5E is a sectional view cut along a plane B4-B4' in FIG. 5A.

As shown in FIG. 4, developing unit 2 includes hopper 200 forming its exterior, and a toner input port 201 for leading toner is formed in this hopper 200 at a position where opening 30*a* (FIG. 3) provided for toner feed device 30 to deliver toner abuts the hopper 200. This hopper 200 reserves the developer therein and incorporates developer roller 202, a paddle roller 203, a mixing roller 204, a conveying roller 205, a regulating member 207 and collecting roller 220.

Developing unit 2 is mounted inside image forming apparatus 1A in such a manner that the peripheral surface (the developer adhering on the peripheral area) of developing roller 202 that is partly exposed from hopper 200 opposes in proximity to the peripheral surface of photoreceptor drum 3. That is, the peripheral surface area of developing roller 202 opposing photoreceptor drum 3 forms the developing position (developing area).

In hopper 200, the toner that was fed from toner feed device 30 (FIG. 3) and input through toner input port 201 is conveyed by conveying roller 205 to mixing roller 204, where the toner is mixed with a magnetic carrier to thereby prepare a dual-component developer. Mixing roller 204 mixes the aforementioned newly formed dual-component developer with the existing developer inside hopper 200. The developer obtained by mixing with mixing roller 204 is tribo-electrified as it is agitated by paddle roller 203, then supplied to developing roller 202 for developing electrostatic latent images, and conveyed by developing roller 202 to the electrostatic latent image formed on photoreceptor drum 3. The developer supplied to developing roller 202 and conveyed thereby is controlled as to its layer thickness by regulating member 207 that is supported by a supporting member 212 as a part of hopper 200. In this way, the supplied amount of developer to be supplied to photoreceptor drum 3 is regulated.

Hopper 200 is made of a metallic material having a high thermal conductivity such as aluminum as a countermeasure against increase in temperature inside developing unit 2, and has an approximately prism-shaped configuration having an opening 200*a* (FIG. 3) facing (opposing) the peripheral surface of photoreceptor drum 3 and also having toner input port 201 for leading toner, formed at a position in abutment with opening 30*a* provided for toner feed device 30 to deliver toner.

Provided on the upper outside part of supporting member 212 that forms the top of hopper 200 is a pressure relief mechanism 217 for reducing the pressure inside hopper 200. This pressure relief mechanism 217 is periodically operated to release the pressure inside developing unit 2 so that toner scattering inside the apparatus can be prevented.

Developing roller 202 is arranged at the position inside hopper 200 where opening 200*a* is formed while conveying roller 205 that conveys the developer (toner) supplied from toner input port 201 into hopper 200 to mixing roller 204 is disposed rotatably at a position that opposes toner input port 201.

A toner concentration sensor 213 for detecting the toner concentration inside hopper 200 is provided at the bottom opposing the lower side of mixing roller 204 in hopper 200 and somewhat closer to the photoreceptor drum 3 side. Image forming apparatus 1A is configured so as to supply toner from toner input port 201 based on the measurement of toner concentration sensor 213 when the amount of toner being mixed and agitated by mixing roller 204 becomes lower than the proper amount.

Arranged adjacent to and below developing roller 202 is collecting roller 220 for collecting the developer leaving developing roller 202.

Developing roller 202 is arranged a development gap (about 0.5 to 1.5 mm) apart from photoreceptor drum 3 as shown in FIG. 4. Developing roller 202 is formed of a magnet roller 214 with multiple magnetic poles and a non-magnetic sleeve 215 that is approximately cylindrically formed of an aluminum alloy, brass or the like and is arranged rotatably over, and relative to the magnet roller 214. In this magnetic roller 214, a plurality of bar magnets having rectangular sections, specifically magnetic pole elements N1 and N2 providing N-pole magnetic fields and magnetic pole elements S1, S2 and S3 providing S-pole magnetic fields, are radially arranged apart one from another in the order shown in FIG. 4.

Magnet roller 214 is unrotatably supported and fixed at its both ends by the side walls of hopper 200. Magnetic pole element N1 is disposed at a position opposing the peripheral surface of photoreceptor drum 3.

The chained line designated at P1 of magnetic pole element N1 represents the center of the width of the magnetic pole element N1 or the central axis of the magnetic pole, with respect to the circumferential direction of developing roller 202. Similarly, the chained line P2 of magnetic pole element N2 represents the center of the width of the magnetic pole element N2 or the central axis of the magnetic pole. These magnetic pole's center axes P1 and P2 are radially extended from the developing roller's central axis O2 and formed across the full length of the magnet elements (across the length of sleeve 215). The magnetic pole element N1 that opposes the peripheral surface of photoreceptor drum 3 is positioned so that the magnetic pole's center axis P1 substantially coincides with the line (plane) that passes through both the center axis of photoreceptor drum 3 and the center axis of developing roller 202.

The above magnetic pole elements are laid out in the order of N1, S3, S2, N2 and S1 in the rotational direction of developing roller 202. The magnetic field created by the thus arranged magnetic pole elements N1, N2, S1, S2 and S3, attracts the dual-component developer particles made of toner and carrier to rotating sleeve 215 so as to form brush-like spikes (to be referred as magnetic brush) extending in the circumferential direction of the sleeve. As the photoreceptor drum 3 rotates, the photoreceptor drum 3 surface is rubbed in the above-mentioned development gap area by the magnetic brush created on rotating developing roller 202 to thereby achieve development.

Regulating member 207 controls the amount of the developer conveyed between itself and developing roller 202 while performing principal electrification of the developer, and is formed of a non-magnetic metal plate having an approximately rectangular section. One end of regulating member 207 opposes the outer peripheral surface of developing roller 202 (sleeve 215) with a gap G1 in between.

Regulating member 207 is disposed inside opening 200*a* of hopper 200 and between magnetic pole elements S1 and N2 and fixed to opening 200*a* by a cover element 216 that is attached to regulating member 207. This regulating member 207 is formed of a non-magnetic metal plate such as aluminum, stainless steel or the like.

Mixing roller 204 agitates and conveys the toner supplied from toner feed device 30 (FIG. 3) as shown in FIG. 5A and is comprised of a rotary shaft 204*a* arranged substantially parallel to developing roller 202 (FIG. 4) and a plurality of separate plate-like agitating elements 204*b* (204*b*1 to 204*b*4).

Agitating elements 204*b* are arranged inclined at an angle of approximately 45 degrees with the direction in which the axis of rotary shaft 204*a* extends (to be referred to as the axial direction). Agitating elements 204*b* include agitating element 204*b*3 disposed at the approximate center, with respect to the axial direction, of rotary shaft 204*a*, a group 204B1 of an agitating element 204*b*1 and multiple agitating elements 204*b*2 arranged on the right side in the drawing and a group 204B2 of an agitating element 204*b*4 and multiple agitating elements 204*b*2 arranged on the left side in the drawing. Here, agitating elements 204*b*1 and 204*b*4 are disposed at both ends with respect to the axial direction of rotary shaft 204*a*.

In the present embodiment, group 204B1 includes as many agitating elements 204*b*2 as group 204B2 does. That is, mixing roller 204 has an odd number of agitating elements 204*b*. Thus, provision of an odd number of agitating elements 204*b* enables the developer to be conveyed and agitated in one specified direction by making the developer flow off-balance as a whole.

As shown in FIGS. 5B and 5E, agitating elements 204*b*1 and 204*b*4 arranged at both ends of rotary shaft 204*a* have approximately semicircular shapes which are point symmetrical with respect to rotary axis 204*a*. Detailedly, agitating elements 204*b*1 and 204*b*4 each have a hemi-elliptic shape by cutting an elliptic shape having a major axis L1 passing through rotary axis 204*a* in half along the line that is substantially perpendicular to the major axis L1.

A plurality of agitating elements 204*b*2 are provided between agitating element 204*b*3 and agitating element 204*b*1 and between agitating element 204*b*3 and agitating element 204*b*4, each being inclined with the axial direction of rotary shaft 204*a* and having a substantially elliptic shape, as shown in FIG. 5C. With this configuration, it is possible to make each agitating element produce a stronger conveying force in the direction of the rotary axis.

Agitating element 204*b*3 arranged at the substantially center of rotary shaft 204*a* has a substantially elliptic shape having a cutout portion 204*c* at the position opposing the aforementioned toner concentration sensor 213 as shown in FIG. 5D, so that light for detection from toner concentration sensor 213 is permitted to pass through. Another cutout portion 204*c* is formed in the agitating element at a position point symmetrical, with respect to the center of rotary axis 204*a*, to the position of the aforementioned cutout. That is, a pair of cutout portions 204*c* are formed at positions point symmetrical to each other with respect to the center of rotary axis 204*a*. Thus, this configuration of agitating element 204*b*3 makes it possible to prevent output ripples from occurring at toner concentration sensor 213 due to developer's volume density change which would occur as agitating element 204*b* of mixing roller 204 rotates.

Arranged between developing roller 202 and mixing roller 204, as shown in FIG. 4 is paddle roller 203, which agitates and electrifies the developer that was prepared by mixing of mixing roller 204 to supply the developer to developing roller 202.

Paddle roller 203 is formed with a supporting shaft extending longitudinally and a plurality of flat plate-like blades radially extending from the supporting shaft so that the blades can rotate about the supporting shaft. As paddle roller 203 rotates about the supporting shaft, the developer can be agitated.

As the characteristic configuration in the developing unit 2, collecting roller 220 for collecting the developer falling from the developing area of developing roller 202 and developer removing device (developer remover) 230 for removing the developer collected by collecting roller 220 from collecting roller 220 are arranged under the developer roller 202.

Collecting roller 220 has a plurality of magnetic poles fixedly arranged with a predetermined gap relative to developing roller 202. The collecting roller is arranged downstream of the developing area of the developing roller 202 with respect to the rotational direction of photoreceptor drum 3, and is rotationally driven against the rotational direction of photoreceptor drum 3.

Next, developer removing device 230 which is the characteristic component of developing unit 2 of the present embodiment will be described in detail with reference to the drawings.

Figure 6A:
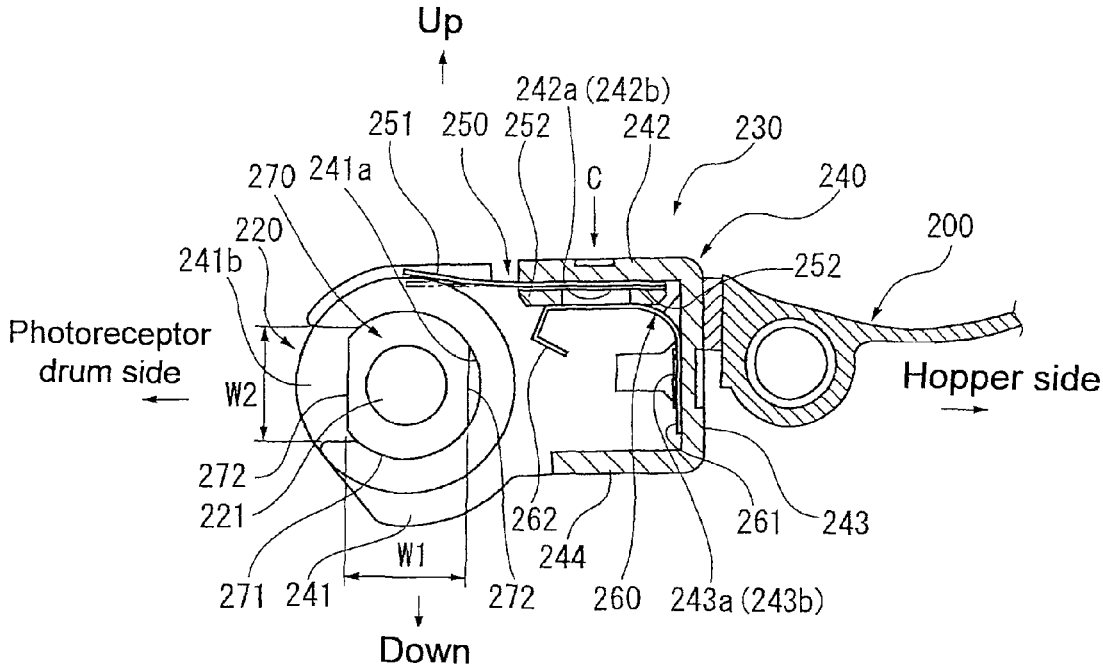
FIG. 6A is a sectional view showing a configuration of a developer removing device that constitutes the developing unit.
Figure 6B:
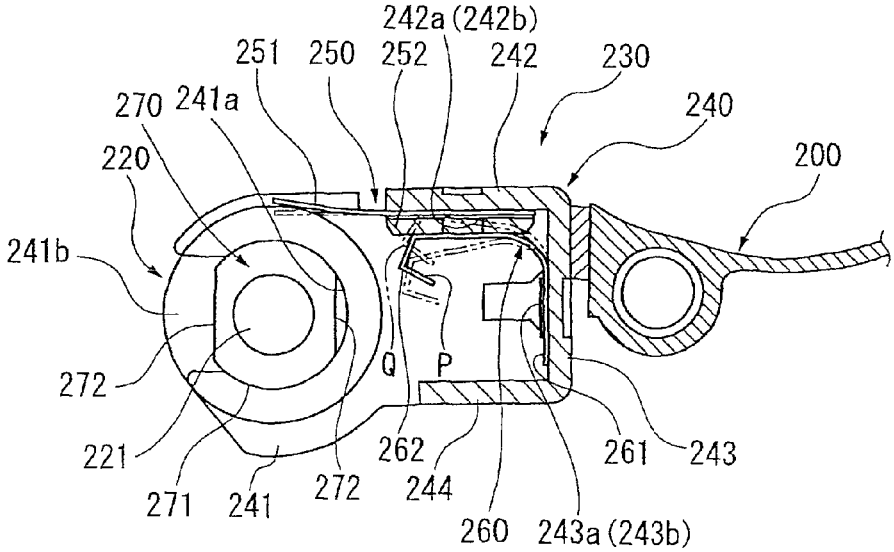
FIG. 6B is an illustrative view for illustrating the operation of a scraper and scraper supporter that constitute the developer removing device.
Figure 7A:
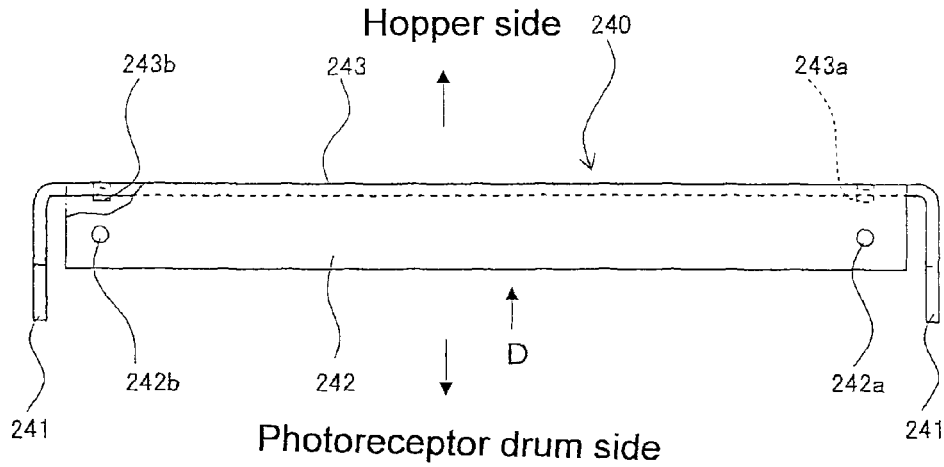
FIG. 7A is a plan view, viewed in the direction of arrow C, showing a casing that constitutes the developer removing device shown in FIG. 6A.
Figure 7B:
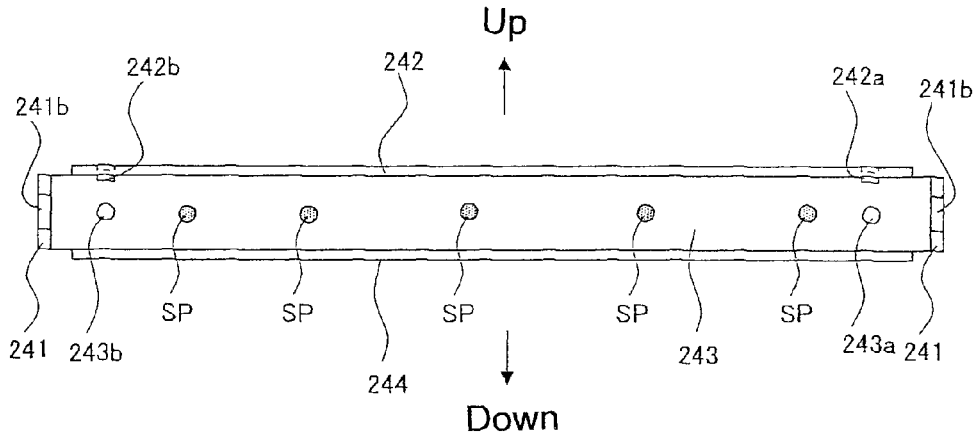
FIG. 7B is a plan view showing the casing, viewed in the direction of arrow D in FIG. 7A.
Figure 8:
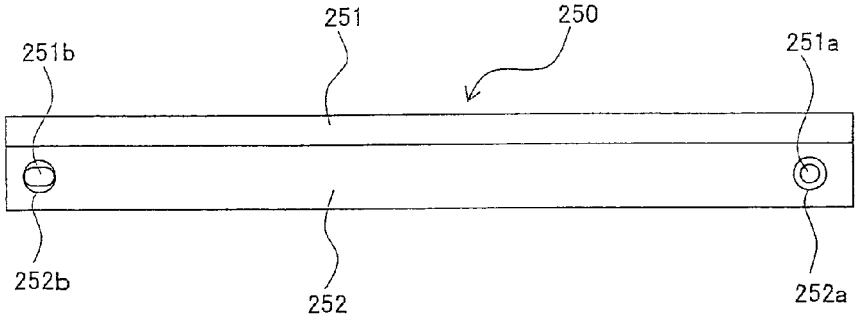
FIG. 8 is a plan view showing the configuration of the scraper.
Figure 9:
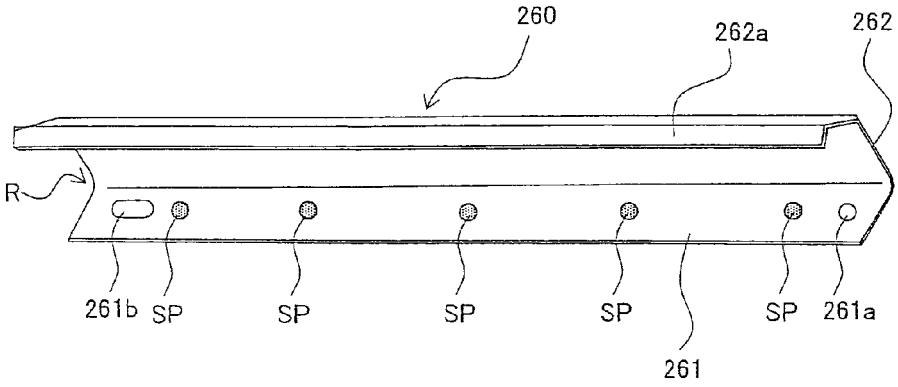
FIG. 9 is a perspective view showing the configuration of the scraper supporter.
Figure 10A:
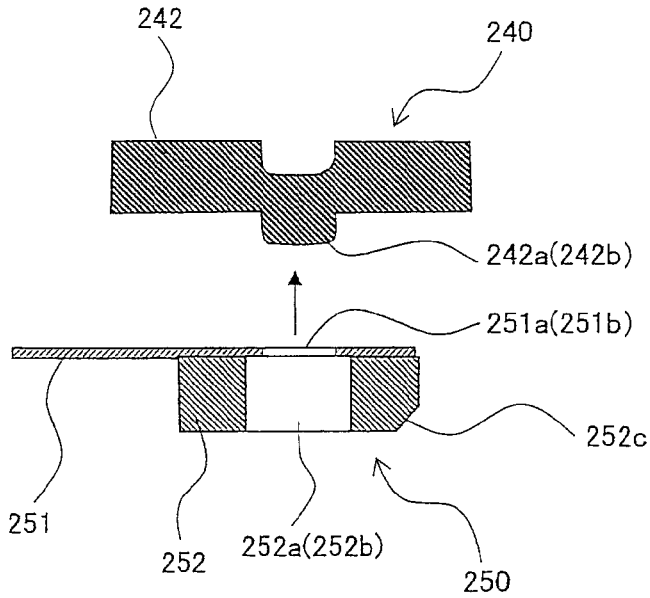
FIG. 10A is an illustrative view showing a mounting operation of the casing and scraper.
Figure 10B:
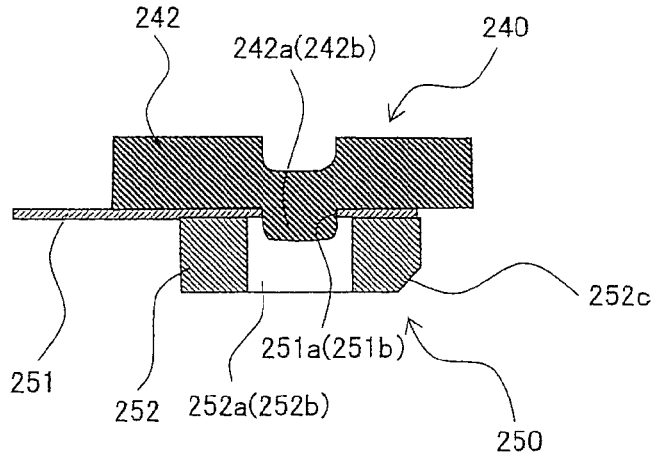
FIG. 10B is a sectional view showing a state where the casing and scraper are fit in place.

FIG. 6A is a sectional view showing a configuration of a developer removing device that constitutes the developing unit of the present embodiment; FIG. 6B is an illustrative view for illustrating the operation of a scraper and scraper supporter that constitute the developer removing device; FIG. 7A is a plan view, viewed in the direction of arrow C, showing a casing that constitutes the developer removing device shown in FIG. 6A; FIG. 7B is a plan view showing the casing, viewed in the direction of arrow D in FIG. 7A; FIG. 8 is a plan view showing the configuration of the scraper; FIG. 9 is a perspective view showing the configuration of the scraper supporter; FIG. 10A is an illustrative view showing amounting operation of the casing and scraper; and FIG. 10B is a sectional view showing a state where the casing and scraper are mounted in place.

(Developer Removing Device 230)

As shown in FIG. 6A, developer removing device 230 is comprised of a casing 240 for holding collecting roller 220, a scraper 250 for removing the developer adhering on the outer periphery of collecting roller 220 and a scraper supporter 260 for supporting scraper 250, and is constructed so that scraper supporter 260 holds scraper 250 by pressing the scraper against casing 240.

(Casing 240)

Casing 240 has an approximately U-shaped section as shown in FIG. 6A, and is essentially contracted of, as shown in FIGS. 7A and 7B, a pair of collecting roller supporters 241 for rotatably holding collecting roller 220, a scraper supporting part (first scraper supporting part) 242 for supporting scraper 250, a scraper supporter attachment (first attachment part) 243 to which scraper supporter 260 is attached and a bottom part 244.

(Collecting Roller Supporter 241)

Collecting roller supporters 241 are formed by bending both ends of casing 240 at right angles with the direction in which the axis of collecting roller 220 extends (to be referred to as the axial direction) (FIG. 7A). Collecting roller supporters 241 are integrally formed with casing 240. Collecting roller supporters 241 position collecting roller 220 relative to hopper 200 of developing unit 2.

Collecting roller supporters 241 are provided with resinous bearings 270 which provide self-lubricating properties, so as to axially support both ends of the shaft, designated at 221, of collecting roller 220 in a rotatable manner by means of these bearings 270.

Collecting roller supporter 241 is formed with an attachment hole 241*a* and an attachment access 241*b*.

Bearing 270 (FIGS. 6A and 6B) has a roughly, cylindrical shape and holds shaft 221 of collecting roller 220 by its hollow part. Bearing 270 is positioned to collecting roller supporter 241 by inserting its outer periphery 271 through attachment access 241*b* of collecting roller supporter 241 into attachment hole 241*a* and fitting therein. Illustratively, this periphery 271 is defined with a pair of semi-cylindrical surfaces and a pair of attachment facets 272 and 272 formed parallel to each other along the bearing 270's axis (the same axis as that of collecting roller 220).

Attachment hole 241*a* is a through hole having substantially the same diameter as the diameter (major axis) of circumferential periphery 271 of bearing 270. However, the attachment hole is not limited to this. That is, it may be a blind hole that is closed on the collecting roller supporter 241's end side.

Attachment access 241*b* is a cutout portion for allowing bearing 270 to be inserted from the circumferentially outside of attachment hole 241*a* into attachment 241*a*. This attachment access 241*b* may also be a blind cutout that is closed on the collecting roller supporter 241's end side.

The open width W2 of attachment access 241*b* and the distance W1 (minor axis) between flat attachment facets 272 and 272 of bearing 270 are specified so that "open width W2≧distance W1" holds.

(Scraper Supporting Part 242)

As shown in FIGS. 7A and 7B, scraper supporting part (first scraper supporting part) 242 is formed with a pair of scraper positioning portions (first and second scraper positioning projections) 242*a* and 242*b* that are circularly projected inwards of casing 240 by so-called half-punching and position scraper 250 at both the longitudinal ends of scraper supporting part 242.

(Scraper Supporter Attachment 243)

Scraper supporter attachment 243 is affixed with its outside surface positioned and fixed to the hopper 200 side (developer unit body side) as shown in FIGS. 7A and 7B.

Scraper supporter attachment (first attachment part) 243 is formed with a pair of scraper supporter positioning portions (first and second scraper supporter positioning projections) 243*a* and 243*b* that are circularly projected inwards of casing 240 by so-called half-punching and position the scraper supporter at both the longitudinal ends of scraper supporter attachment 243.

(Scraper 250)

As shown in FIGS. 6A and 8, scraper 250 is arranged elongated along the axial direction of collecting roller 220 with its distal end abutted against the outer peripheral surface of collecting roller 220 in a counter manner by its elastic deformation (flexible deformation) so as to scrape down the carrier particles that dropped from the developing area and have been captured by the collecting roller 220 surface by the magnetic attraction of collecting roller 220 and return the collected carrier to hopper 200.

In the present embodiment, scraper 250 is comprised of a plate-like blade 251 and a holder 252 that supports the blade 251 and also functions as a reinforce. The blade 251 and holder 252 are integrally laminated in their longitudinal direction with blade 251 exposed on its one side edge (the side edge to be abutted against collecting roller 220).

(Blade 251)

Blade 251 is formed of a stainless sheet of 0.1 mm thick, and has a pair of holes, i.e., a circular fitting hole (the first scraper-side engaging portion) 251*a* (FIG. 8) and an elongated (elliptic shaped) fitting hole (the second scraper-side engaging portion) 251*b* (FIG. 8) extended in the longitudinal direction of blade 251 as the engaging portions (scraper-side engaging portions) corresponding to scraper positioning portions 242*a* and 242*b*, respectively. Fitting hole 251*b* is formed in such a shape as to allow scraper positioning portion 242*b* to be moved (adjusted in position) with respect to the longitudinal direction of scraper supporting part 242 or blade 251.

That is, blade 251 is exactly positioned by fitting circular fitting hole 251*a* to one of scraper positioning portions, 242*a* while elongated fitting hole 251*b* is fitted to the other scraper positioning portion 242*b*. Formation of fitting hole 251*b* as an elongated hole makes it possible to make an adjustment in position in the longitudinal direction when fitting hole 251*b* is engaged with scraper positioning portion 242*b* even if the attachment position gets out of place due to shaping accuracy, shape errors and the like. As a result, it is possible to ensure the mounting of blade 251 to scraper positioning portions 242*a* and 242*b*.

(Holder 252)

Holder 252 is formed of a stainless sheet of 1 mm thick, and has through holes 252*a* and 252*b* formed at the positions opposing fitting holes 251*a* and 251*b* of blade 251 as shown in FIG. 8. Through holes 252*a* and 252*b* are formed to be greater in diameter than fitting holes 251*a* and 251*b* so as not to interfere with scraper positioning portions 242*a* and 242*b* to be fitted to the fitting holes 251*a* and 251*b*. Further, as shown in FIGS. 6A, 10A and 10B, the edges, of holder 252, extending along the longitudinal direction (the axial direction of collecting roller 220), located on the opposite side (the surface side) from the holder 252's attachment surface to which blade 251 is attached are beveled at approximately 45 degrees by forming edge portions 252*c*. Though edge portion 252*c* has the effect as describe below when scraper 250 is attached to casing 240, it is not necessarily formed. If edge portions 252*c* are formed, it is good enough if at least the edge that is located on the front side of the holder with respect to the direction in which scraper 250 is attached to casing 240, or on the side that will touch scraper supporter 260 when scraper 250 is mounted to casing 240 (FIGS. 10A and 10B) is beveled.

(Scraper Supporter 260)

Scraper supporter (supporter) 260 has an approximately J-shaped section as shown in FIG. 6A. Further, as shown in FIG. 9, the scraper supporter is formed elongated along scraper 250 and is formed along its longitudinal direction with an attachment surface (second attachment part) 261 and a supporting surface (second scraper supporting part) 262.

Attachment surface 261 is attached to scraper supporter attachment 243 in casing 240.

Supporting surface 262 positions and holds scraper 250 with casing 240 by pressing scraper 250 against scraper supporting part 242 along the axial direction of the collecting roller 220 (the longitudinal direction of scraper).

In the present embodiment, scraper supporter 260 is formed of a material for leaf spring in such a shape that when attachment surface 261 is affixed to casing 240, the supporting surface 262 uniformly presses scraper 250 across the axial length of collecting roller 220. Accordingly, scraper 250 is urged toward scraper supporting part 242 by scraper supporter 260.

(Supporting Surface 262)

As shown in FIG. 6B, supporting surface 262 is set at a position designated at Q in the drawing when scraper 250 is not mounted. That is, it is located closer to scraper supporting part 242 than it is located at the position designated at P in the drawing when scraper 250 is mounted properly. In other words, scraper 250 is mounted between supporting surface 262 and scraper supporting part 242, opposing the elastic force of supporting surface 262 so that scraper 250 is supported by scraper supporter 260 by the elastic force that is generated by the displacement of supporting surface 262 (the displacement from position Q to position P).

Further, supporting surface 262 is bent (curved) on the free end side across its full length so that its distal end 262*a* (FIG. 9) extends in the opposite direction of scraper 250. Since this configuration enhances the rigidity of the distal end 262*a* (free end), supporting surface 262 is able to press scraper 250 uniformly with respect to the axial direction of collecting roller 220. As a result, it is possible to uniformly abut scraper 250 against collecting roller 220 across the full length thereof without causing any deformation in scraper 250 with respect to the axial direction of collecting roller 220. This configuration of distal end 262*a* also contributes to facilitating insertion of scraper 250.

(Attachment Surface 261)

On the other hand, formed on attachment surface 261 (second attachment part) of scraper supporter 260 as the engaging portions (supporter side engaging portions) corresponding to scraper supporter positioning portions 243*a* and 243*b* are a pair of holes, i.e., a circular fitting hole (the first supporter-side engaging portion) 261*a* and an elongated (elliptic shaped) fitting hole (the second supporter-side engaging portion) 261*b* extended in the longitudinal direction of the scraper supporter 260. Fitting hole 261*b* is formed in such a shape as to allow scraper supporter positioning portion 243*b* to be moved (adjusted in position) with respect to the longitudinal direction of scraper supporter attachment 243 or blade 251.

That is, attachment surface 261 is exactly positioned by fitting circular fitting hole 261*a* to one of scraper supporter positioning portions, 243*a* while elongated fitting hole 261*b* is fitted to the other scraper supporter positioning portion 243*b*. Formation of fitting hole 261*b* as an elongated hole makes it possible to make an adjustment in position in the longitudinal direction when fitting hole 261*b* is engaged with scraper supporter positioning portion 243*b* even if the attachment position gets out of place due to shaping accuracy, shape errors and the like. As a result, it is possible to ensure the attachment of attachment surface 261 of scraper supporter 260 to scraper supporter positioning portions 243*a* and 243*b*.

Further, attachment surface 261 is fixed to scraper supporter attachment 243 along its length by spot-welding at five spots SP. In the present embodiment, since scraper supporter 260 is bent forming an L-shaped curved portion across its full length between attachment surface 261 and supporting surface 262 while front end 262*a* of supporting surface 262 is flexed so as to enhance rigidity, the influence from the stress concentration generated by spot welding at five spots SP can be eliminated. As a result, it is possible to uniformly press and support scraper 250 by making supporting surface 262 uniformly flex and deform.

Next, the mounting of developer removing device 230 (FIGS. 6A and 6B) according to the present embodiment will be described.

First, when scraper supporter 260 is attached to casing 240, attachment surface 261 of scraper supporter 260 is placed along scraper supporter attachment 243 (243*a*, 243*b*) of casing 240, as shown in FIGS. 7B and 9.

Then, the circular fitting hole 261*a* of attachment surface 261 is fitted on scraper supporter positioning portion 243*a* of scraper supporter attachment 243, to thereby position one end side. Thereafter, elongated fitting hole 261*b* is fitted onto scraper supporter positioning portion 243*b* to thereby position scraper supporter 260 to casing 240. Then, scraper supporter 260 is fixed to casing 240 by spot welding SP.

Next, to mount scraper 250 to casing 240, front end 262*a* of supporting surface 262 of scraper supporter 260 is brought away from casing 240 by opposing the elastic force so that scraper 250 is interposed between casing 240 and supporting surface 262 of scraper supporter 260.

At this time, scraper 250 is set with its blade 251 side opposing scraper supporting part 242 of casing 240, as shown in FIGS. 6A and 6B. Then, as shown in FIGS. 10A and 10B, circular fitting hole 251*a* formed in blade 251 is fitted onto scraper positioning portion 242*a* of scraper supporting part 242 to thereby position one end side. Thereafter, elongated fitting hole 251*b* is fitted onto scraper positioning portion 242*b* to thereby position scraper 250 to casing 240. Thus, scraper 250 is held and positioned by the elastic force of supporting surface 262 of scraper supporter 260.

Next, when collecting roller 220 is mounted to casing 240, each bearing 270 is fitted into corresponding attachment hole 241*a* with its attachment facets 272 (having a shorter size W1) in alignment with opening W2 of attachment access 241*b* (FIG. 7A) of collecting roller supporter 241 of casing 240. Then, the bearing 270 is rotated so as to shift the short-sized portion W1 away from the opening W2 to thereby match the semi-cylindrical surfaces of periphery 271 of bearing 270 with the circular part of attachment hole 241*a*.

As described above, it is possible to construct developer removing device 230 as an integrated structure by assembling collecting roller 220 and scraper 250, which are prepared separately, into casing 240.

Since, as constructed above it is not only possible to assemble collecting roller 220 and scraper 250 simply and exactly with a simple structure, but also make scraper 250 abut uniformly and stably against collecting roller 220, the developer that drops from the developing area can be reliably collected by collecting roller 220 and the developer collected by collected roller 200 can be efficiently removed by developer removing device 230.

Further, according to the present embodiment, casing 240, scraper 250 and scraper supporter 260 are constructed so that they can be assembled without using any screw fastening or the like as described above, collecting roller 220 and scraper 250 can be fixed simply and exactly and can be assembled and disassembled by one-touch handling. As a result, it is possible to markedly improve workability and maintenance performance.

Further, according to the present embodiment, since a beveled surface is formed as edge portion 252*c* at the front end of holder 252 that is inserted first, and since the distal end 262*a* of scraper supporter 260 is bent at a predetermined angle so that the front end 262*a* of scraper supporter 260 always spreads open and outwards (is set floated), upon insertion of scraper 250 into and between casing 240 the other side surface 262 of scraper supporter 260 can be spread open easily when edge portion 252*c* of holder 252 abuts front end 262*a* of scraper supporter 260, it hence is possible to insert scraper 250 easily.

Also, according to the present embodiment, since use of a leaf-spring material for scraper supporter 260 provides a clipping function to nip holder 252, it is possible to press and fix scraper 250 to casing 240 in a simple manner.

Further, according to the present embodiment, since the supporting surface 262 of scraper supporter 260 is adapted to come into area contact with holder 252 of scraper 250, the scraper 250 can be uniformly pressed against casing 240 by scraper supporter 260.

Though in the present embodiment the bent portion formed between attachment surface 261 and supporting surface 262 of scraper supporter 260 is approximately J-shaped so that the flat portion of supporting surface 262 abuts the top surface of holder 252, the bent shape of scraper supporter 260 of the present invention is not limited to this.

Figure 11:
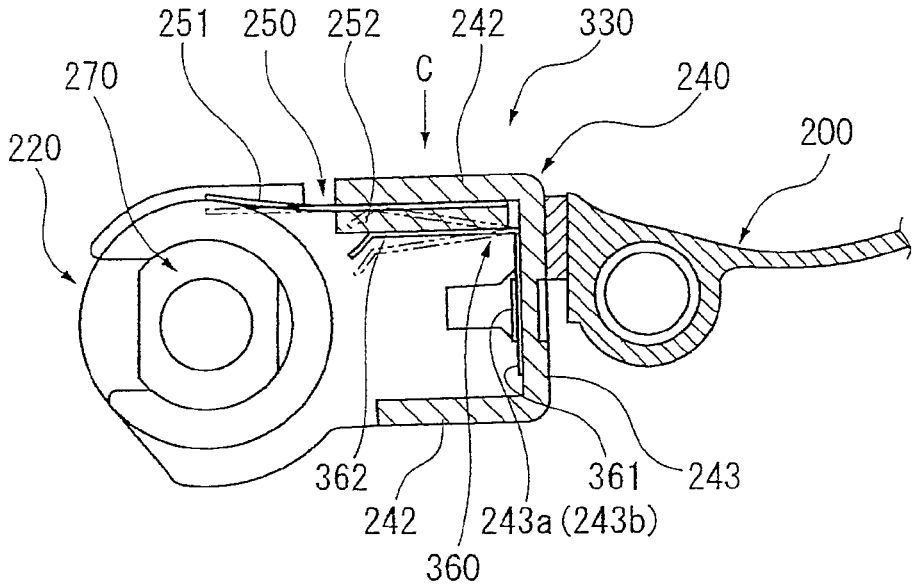
FIG. 11 is an illustrative view showing a variational example of a scraper supporter configuration according to the present embodiment.

As a variational example of the present embodiment, the bent portion between an attachment surface 361 and supporting surface 362 of a scraper supporter 330 may be formed in an approximately L-shape, as shown in FIG. 11. Here, in FIG. 11, description of the other components having the same configurations as those in developer removing device 230 of the above-described embodiment is omitted by allotting the same reference numerals.

Further, though, in the present embodiment, the positioning of scraper 250 is done by forming projections as scraper positioning portions 242*a* and 242*b* by half-punching the scraper supporting part 242 of casing 240, the present invention should no be limited to this. That is, projections may be formed on the scraper supporter side to position scraper 250. A variational example of the present embodiment will be described below.

Figure 12:
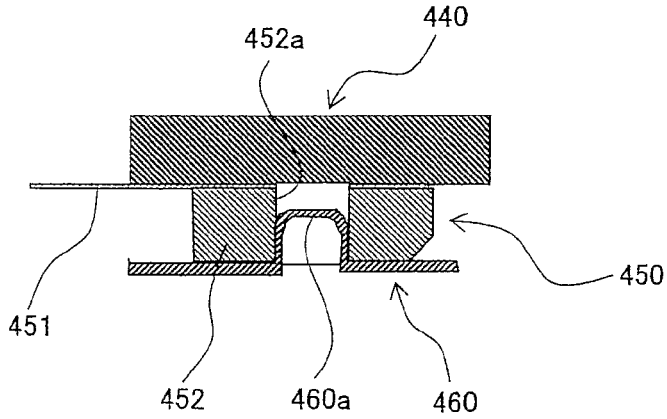
FIG. 12 is an illustrative view showing a variational example of a scraper positioning structure according to the present embodiment.

FIG. 12 shows a variational example of the present embodiment. Though not illustrated, a scraper supporter 460 is positioned and fixed to a casing 440. In this case, a scraper 450 may be positioned to scraper supporter 460 as follows. That is, in scraper supporter 460, a pair of fitting portions 460*a* (scraper positioning portions: first and second scraper positioning projections) are formed in the area where the scraper supporter abut a holder 452 of a blade 451 of scraper 450, at both ends in its length. In holder 452, a pair of fitting holes 452*a* (scraper side engaging portions) are formed at the positions corresponding to the above two fitting portions 460*a*. In this arrangement, one fitting portion 460*a* is fitted to corresponding fitting hole 452*a* (first scraper side engaging portion), then the other fitting portion 460*a* is engaged with its corresponding fitting hole 452*a* (second scraper side engaging portion) in a position-adjustable manner as in the above embodiment. Since it is possible with this configuration to integrally position scraper 450 with scraper supporter 460 with a simple manner, mounting of scraper 450 into casing 440 can be made easy. Here, it should be noted that the positioning accuracy between scraper 450 and casing 440 becomes prone to be affected by the bending accuracy of scraper supporter 460 and the shaping accuracy of fitting portions 460*a*.

Having described preferred embodiments of the present invention, it goes without saying that the present invention should not be limited to the above-described examples, and it is obvious that various changes and modifications will occur to those skilled in the art within the scope of the appended claims. Such variations are therefore understood to be within the technical scope of the present invention.

For example, in the above-described embodiment, the present invention is applied to an image forming apparatus including a monochrome developing unit, but the present invention can be also be applied to a color image forming apparatus including a plurality of developing units.

What is claimed is:

1. A developing unit for visualizing an electrostatic latent image formed on an electrostatic latent image bearer with a developer that is prepared and electrified by mixing two components, an electrostatically chargeable toner and magnetic carrier, comprising:

a collecting roller for collecting the developer falling from the developing area of a developing roller that supplies the toner to the electrostatic latent image bearer, wherein the collecting roller does not contact the developing roller; and a developer remover for removing the developer collected by the collecting roller from the collecting roller, characterized in that the developer remover comprises:

a casing for supporting the collecting roller;

a scraper disposed elongated along the axial direction of the collecting roller and abutted against the outer periphery of the collecting roller so as to scrape off the developer adhering to the outer periphery of the collecting roller; and, a supporter for supporting the scraper, and the supporter presses the scraper against the casing to hold the scraper.

2. The developing unit according to claim 1, wherein the scraper includes a plate-like blade and a holder for holding the blade, and the holder is laid over the blade along the longitudinal direction of the blade.

3. The developing unit according to claim 1, wherein the supporter is formed of a leaf-spring material, abuts the scraper uniformly with respect to the axial direction of the collecting roller and presses the scraper toward the casing.

4. The developing unit according to claim 1, wherein the supporter is formed so that the distal end of the abutment portion that abuts the scraper against the casing is bent or curved in a direction opposite to the scraper.

5. A developing unit for visualizing an electrostatic latent image formed on an electrostatic latent image bearer with a developer that is prepared and electrified by mixing two components, an electrostatically chargeable toner and magnetic carrier, comprising:

a collecting roller for collecting the developer falling from the developing area of a developing roller that supplies the toner to the electrostatic latent image; and a developer remover for removing the developer collected by the collecting roller from the collecting roller, characterized in that the developer remover comprises:

a casing for supporting the collecting roller;

a scraper disposed elongated along the axial direction of the collecting roller and abutted against the outer periphery of the collecting roller so as to scrape off the developer adhering to the outer periphery of the collecting roller; and, a supporter for supporting the scraper, and the supporter presses the scraper against the casing to hold the scraper;

wherein the casing comprises:

a collecting roller supporter for rotatably supporting the collecting roller;

a first scraper supporting part for supporting the scraper; and, a first attachment part to which the supporter is attached, the casing is mounted to the developing unit body which has the developing roller disposed therein and stores the developer, and the supporter comprises:

a second attachment part attached to the first attachment part; and a second scraper supporting part for supporting the scraper against the first scraper supporting part along the axial direction of the collecting roller.

6. The developing unit according to claim 5, wherein the first scraper supporting part includes a scraper positioning portion for positioning the scraper, and the scraper has a scraper-side engaging portion corresponding to the scraper positioning portion.

7. The developing unit according to claim 6, wherein the scraper positioning portion has first and second scraper positioning projections that are formed at both longitudinal ends of the first scraper supporting part and are projected towards the side to which the scraper is attached, and the scraper-side engaging portion has first and second scraper-side engaging portions, the first scraper-side engaging portion having a configuration for fitting the first scraper positioning projection therein, and the second scraper-side engaging portion having a configuration that allows for movable engagement of the second scraper positioning projection with respect to the longitudinal direction of the first scraper supporting part.

8. The developing unit according to claim 5, wherein the first attachment part has a supporter positioning portion for positioning the supporter, and the second attachment part has a supporter-side engaging portion corresponding to the supporter positioning portion.

9. The developing unit according to claim 8, wherein the supporter positioning portion has first and second supporter positioning projections that are formed at both longitudinal ends of the first attachment part and are projected towards the side to which the supporter is attached, and the supporter-side engaging portion has first and second supporter-side engaging portions, the first supporter-side engaging portion having a configuration for fitting the first supporter positioning projection therein, and the second supporter-side engaging portion having a configuration that allows for movable engagement of the second supporter positioning projection with respect to the longitudinal direction of the first attachment part.

10. The developing unit according to claim 5, wherein the collecting roller supporter axially and rotatably supports the collecting roller at both ends thereof by means of resinous bearings.

11. The developing unit according to claim 5, wherein the second scraper supporting part includes a scraper positioning portion for positioning the scraper, and the scraper has a scraper-side engaging portion corresponding to the scraper positioning portion.

12. The developing unit according to claim 11, wherein the scraper positioning portion has first and second scraper positioning projections that are formed at both longitudinal ends of the second scraper supporting part and are projected towards the side to which the scraper is attached, the scraper-side engaging portion has first and second scraper-side engaging portions, the first scraper-side engaging portion having a configuration for fitting the first scraper positioning projection therein, and the second scraper-side engaging portion having a configuration that allows for movable engagement of the second scraper positioning projection with respect to the longitudinal direction of the second scraper supporting part.

13. An image forming apparatus, which includes a developing unit for visualizing an electrostatic latent image formed on an electrostatic latent image bearer with a developer that is prepared and electrified by mixing two components, an electrostatically chargeable toner and magnetic carrier, comprising: a collecting roller for collecting the developer falling from the developing area of a developing roller that supplies the toner to the electrostatic latent image bearer, wherein the collecting roller does not contact the developing roller; and a developer remover for removing the developer collected by the collecting roller from the collecting roller, and which produces a printed output of an image by transferring a developer image formed on the surface of the electrostatic latent image bearer to a transfer medium, by an electrophotographic process, characterized in that the developer remover comprises:

a casing for supporting the collecting roller;

a scraper disposed elongated along the axial direction of the collecting roller and abutted against the outer periphery of the collecting roller so as to scrape off the developer adhering to the outer periphery of the collecting roller; and, a supporter for supporting the scraper, and the supporter presses the scraper against the casing to hold the scraper.

14. The image forming apparatus according to claim 13, wherein the scraper includes a plate-like blade and a holder for holding the blade, and the holder is laid over the blade along the longitudinal direction of the blade.

15. The image forming apparatus according to claim 13, wherein the supporter is formed of a leaf-spring material, abuts the scraper uniformly with respect to the axial direction of the collecting roller and presses the scraper toward the casing.

16. The image forming apparatus according to claim 13, wherein the supporter is formed so that the distal end of the abutment portion that abuts the scraper against the casing is bent or curved in a direction opposite to the scraper.

17. An image forming apparatus, which includes a developing unit for visualizing an electrostatic latent image formed on an electrostatic latent image bearer with a developer that is prepared and electrified by mixing two components, an electrostatically chargeable toner and magnetic carrier, comprising: a collecting roller for collecting the developer falling from the developing area of a developing roller that supplies the toner to the electrostatic latent image bearer; and a developer remover for removing the developer collected by the collecting roller from the collecting roller, and which produces a printed output of an image by transferring a developer image formed on the surface of the electrostatic latent image bearer to a transfer medium, by an electrophotographic process, characterized in that the developer remover comprises:

a casing for supporting the collecting roller;

a scraper disposed elongated along the axial direction of the collecting roller and abutted against the outer periphery of the collecting roller so as to scrape off the developer adhering to the outer periphery of the collecting roller; and, a supporter for supporting the scraper, and the supporter presses the scraper against the casing to hold the scraper;

wherein the casing comprises:

a collecting roller supporter for rotatably supporting the collecting roller;

a first scraper supporting part for supporting the scraper; and, a first attachment part to which the supporter is attached, the casing is mounted to the developing unit body which has the developing roller disposed therein and stores the developer, and the supporter comprises:

a second attachment part attached to the first attachment part; and a second scraper supporting part for supporting the scraper against the first scraper supporting part along the axial direction of the collecting roller.

18. The image forming apparatus according to claim 17, wherein the first scraper supporting part includes a scraper positioning portion for positioning the scraper, and the scraper has a scraper-side engaging portion corresponding to the scraper positioning portion.

19. The image forming apparatus according to claim 18, wherein the scraper positioning portion has first and second scraper positioning projections that are formed at both longitudinal ends of the first scraper supporting part and are projected towards the side to which the scraper is attached, and the scraper-side engaging portion has first and second scraper-side engaging portions, the first scraper-side engaging portion having a configuration for fitting the first scraper positioning projection therein, and the second scraper-side engaging portion having a configuration that allows for movable engagement of the second scraper positioning projection with respect to the longitudinal direction of the first scraper supporting part.

20. The image forming apparatus according to claim 17, wherein the first attachment part has a supporter positioning portion for positioning the supporter, and the second attachment part has a supporter-side engaging portion corresponding to the supporter positioning portion.

21. The image forming apparatus according to claim 20, wherein the supporter positioning portion has first and second supporter positioning projections that are formed at both longitudinal ends of the first attachment part and are projected towards the side to which the supporter is attached, and the supporter-side engaging portion has first and second supporter-side engaging portions, the first supporter-side engaging portion having a configuration for fitting the first supporter positioning projection therein, and the second supporter-side engaging portion having a configuration that allows for movable engagement of the second supporter positioning projection with respect to the longitudinal direction of the first attachment part.

22. The image forming apparatus according to claim 17, wherein the collecting roller supporter axially and rotatably supports the collecting roller at both ends thereof by means of resinous bearings.

23. The image forming apparatus according to claim 17, wherein the second scraper supporting part includes a scraper positioning portion for positioning the scraper, and the scraper has a scraper-side engaging portion corresponding to the scraper positioning portion.

24. The image forming apparatus according to claim 23, wherein the scraper positioning portion has first and second scraper positioning projections that are formed at both longitudinal ends of the second scraper supporting part and are projected towards the side to which the scraper is attached, the scraper-side engaging portion has first and second scraper-side engaging portions, the first scraper-side engaging portion having a configuration for fitting the first scraper positioning projection therein, and the second scraper-side engaging portion having a configuration that allows for movable engagement of the second scraper positioning projection with respect to the longitudinal direction of the second scraper supporting part.

* * * * *